US009677852B2

(12) United States Patent
Tikochinski et al.

(10) Patent No.: US 9,677,852 B2
(45) Date of Patent: Jun. 13, 2017

(54) REMOTE CONTROLLED NON-LETHAL WEAPON STATION

(71) Applicant: RAFAEL ADVANCED DEFENSE SYSTEMS LTD., Haifa (IL)

(72) Inventors: Moti Tikochinski, Hgilboa (IL); Amazia Gartner, Haifa (IL); Netanel Shapiro, Zippori (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 14/560,535

(22) Filed: Dec. 4, 2014

(65) Prior Publication Data

US 2015/0082977 A1 Mar. 26, 2015

Related U.S. Application Data

(63) Continuation-in-part of application No. PCT/IL2013/050475, filed on Jun. 3, 2013.

(30) Foreign Application Priority Data

Jun. 4, 2012 (IL) ..... 220159

(51) Int. Cl.

| | |
|---|---|
| ***F41A 23/24*** | (2006.01) |
| ***F41G 3/22*** | (2006.01) |
| ***F41A 27/18*** | (2006.01) |
| ***F42B 5/145*** | (2006.01) |
| ***F41H 13/00*** | (2006.01) |

(Continued)

(52) U.S. Cl.

CPC ..... *F41G 3/22* (2013.01); *F41A 9/61* (2013.01); *F41A 19/59* (2013.01); *F41A 23/24* (2013.01);

(Continued)

(58) Field of Classification Search

CPC ..... F41A 23/20; F41A 23/24; F41A 27/18; F41A 27/20

USPC ..... 89/37.21, 37.02, 41.05, 41.07, 41.08

See application file for complete search history.

(56) References Cited

U.S. PATENT DOCUMENTS 4,848,236 A * 7/1989 Hembise ..... F42B 23/04 102/213

6,701,818 B1 * 3/2004 O'Dwyer ..... A62C 3/025 181/116

(Continued)

FOREIGN PATENT DOCUMENTS

| | | |
|---|---|---|
| CN | 2740468 | 11/2005 |
| EP | 2219009 | 8/2010 |
| WO | 2012015777 | 2/2012 |

*Primary Examiner* — Stephen M Johnson

(74) *Attorney, Agent, or Firm* — Rodney J. Fuller; Booth Udall Fuller, PLC

(57) ABSTRACT

A Remote Controlled Weapon Station is provided wherein it comprises a weapon mounting bracket that is remotely adjustable in elevating/lowering and a rotatable turret assembly adapted to be mounted on vehicles, remotely adjustable in rotation, and wherein the weapon mounting bracket is pivotally mounted on it, and the Remote Controlled Weapon Station is converted into a remote controlled Non Lethal weapon station by that at least one non lethal means is installed in it, chosen from a group consisting of—a multi barreled means for firing grenades; multi-barrels launcher means for pyrotechnically firing plurality of charges; acoustic means for producing tones; illuminating means; observation means and means for providing sniper firing capabilities of small caliber kinetic bullet.

13 Claims, 14 Drawing Sheets

Figure 1:
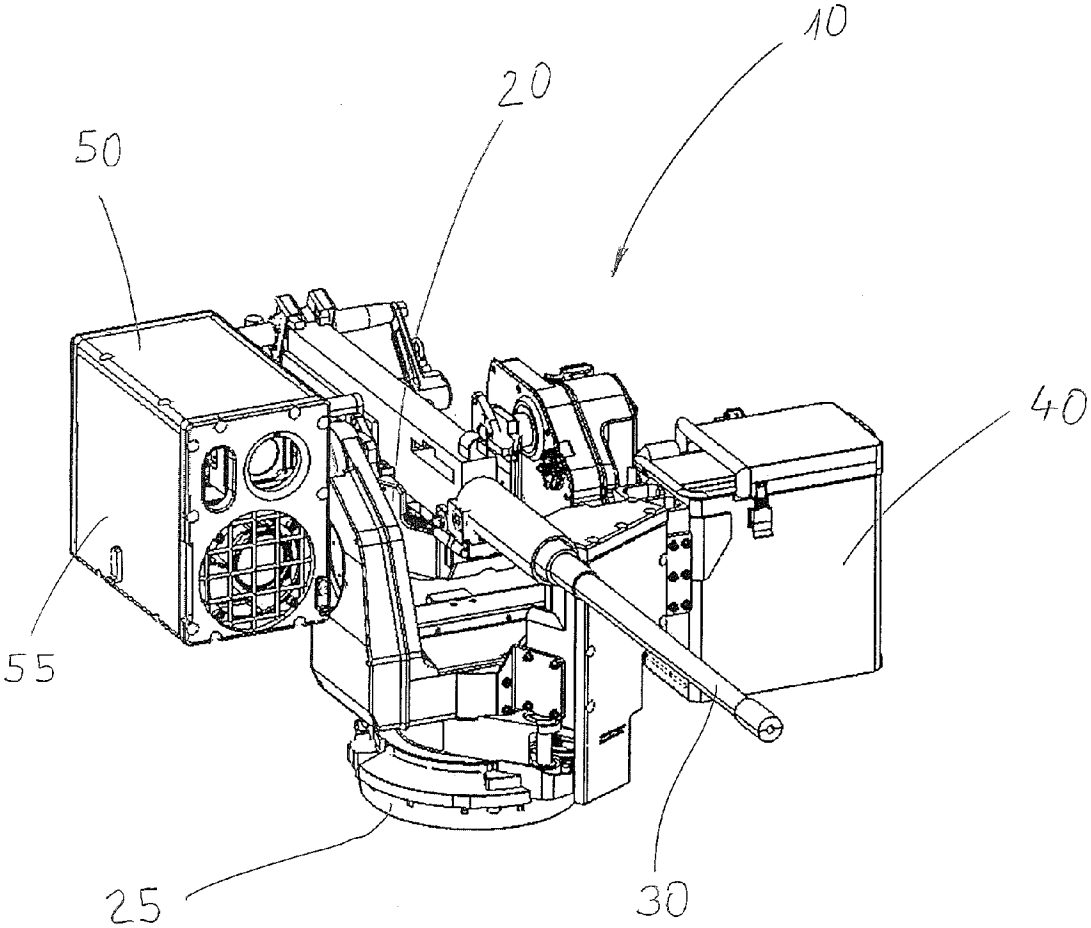

(51) Int. Cl.

| | |
|---|---|
| ***F41H 5/02*** | (2006.01) |
| ***F42B 5/155*** | (2006.01) |
| ***F41A 9/61*** | (2006.01) |
| ***F41A 19/59*** | (2006.01) |
| ***F41F 1/00*** | (2006.01) |
| ***F41G 5/14*** | (2006.01) |
| ***F41H 5/20*** | (2006.01) |

(52) U.S. Cl.

CPC ..... *F41A 27/18* (2013.01); *F41F 1/00* (2013.01); *F41G 5/14* (2013.01); *F41H 5/026* (2013.01); *F41H 5/20* (2013.01); *F41H 13/0081* (2013.01); *F41H 13/0087* (2013.01); *F42B 5/145* (2013.01); *F42B 5/155* (2013.01)

(56) References Cited

U.S. PATENT DOCUMENTS

| | | | | |
|---|---|---|---|---|
| 7,322,267 | B1 * | 1/2008 | Munson, Jr. ..... | F41H 5/007 89/36.01 |
| 8,833,231 | B1 * | 9/2014 | Venema ..... | F41G 3/16 89/204 |
| 2004/0050240 | A1 * | 3/2004 | Greene ..... | F41G 3/06 89/41.06 |
| 2005/0252368 | A1 * | 11/2005 | Berejnoi ..... | F41A 27/26 89/37.01 |
| 2010/0071540 | A1 | 3/2010 | Cazalieres | |
| 2011/0197747 | A1 | 8/2011 | Schneider | |
| 2011/0235465 | A1 | 9/2011 | Bostick | |
| 2012/0174741 | A1 * | 7/2012 | Rogers ..... | B24C 5/02 89/1.8 |

* cited by examiner

Fig. 4c
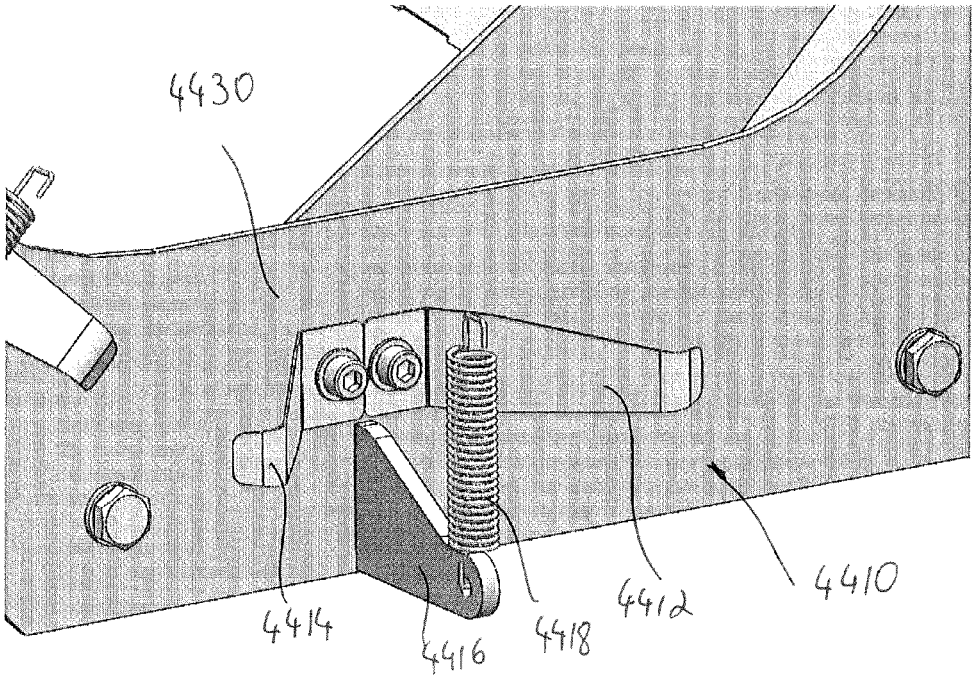
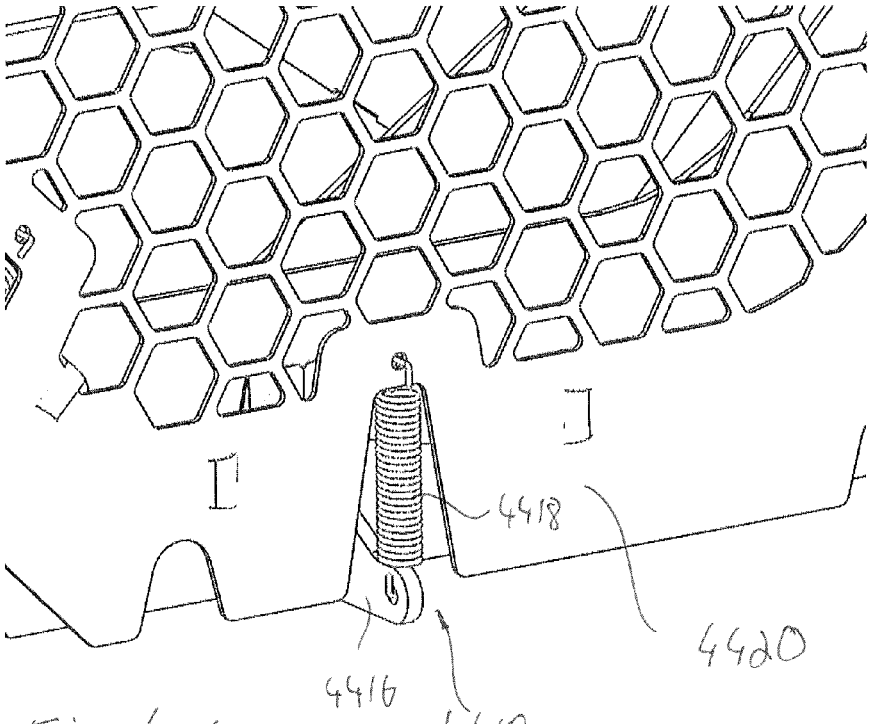
Fig. 4d

REMOTE CONTROLLED NON-LETHAL WEAPON STATION

CROSS-REFERENCE TO RELATED APPLICATIONS

This application is a continuation-in-part of International Application No. PCT/IL2013/050475, filed Jun. 3, 2013, which claims the benefit of and priority to Israeli Patent Application No. 220159, filed Jun. 4, 2012, the contents of each of which are expressly incorporated in their entireties.

FIELD OF THE INVENTION

The invention, the subject matter of this patent application, combines the domain of non-lethal weapons with the field of Remote Controlled Weapon Station (hereinafter—RCWS).

BACKGROUND OF THE INVENTION

The increasing frequency of Low Intensity Conflicts (LIC) in which army units (as distinguished from police forces that are naturally experienced and skilled), are at times required to cope with violent events and conflicts by application of only reasonable force—for example dispersing demonstrations or processions, as well as the increased frequency of Operations Other Than War (OOTW, also known as "peace operations"), wherein the military or police forces involved are challenged with crowd control type of missions as well as fighting ones, has led to developing a variety of Non-Lethal Weapons (hereinafter—NLW).

By developing NLW, it is tried to obtain maximum stopping capability, reduced damage to the opponents (antagonists) and collateral damage to those in the conflict area immediate vicinity and to minimize the dangers to which those operating the NLW are exposed.

NLW that are the products of development, post operational and logistics challenges to military units that—as a rule, are equipped with and trained rather to operate lethal fighting means.

Certain types of non-lethal ammunition are suitable to be fired from the same weapons that serve also as deadly weapons of those units, but partly they do not enable to exploit all the capabilities embodied in the lethal armament in their possession. For example, non lethal ammunition (clusters of rubber balls, plastic rounds, salt packages etc.), that has a diameter that suits, as if, for firing from a grenade machine gun, (such as for example the Mk-19), is absolutely not given for firing automatic fire from it, because the operation of this machine gun uses the pressure in the firing chamber for its repeated gun's cocking (blow back principle) and this mandates ammunition that produces high pressure while the non lethal ammunition produces only low pressure that is not sufficient for cocking the (grenade) machine gun.

Concurrently, other Non-Lethal means are naturally specifically dedicated and not included in the known arsenal of fighting army units and hence the provisioning required for them hampers (inconveniences) the units and compels them to increase the variety of means in their equipment, with an accompanying logistic encumbrance and thus also requiring wider related expertise. For example—an acoustic means like an extremely strong loud-speaker (Long Range Acoustic Device—LRAD), tear gas grenades that are fired from a dedicated launcher or an array of canister tubes, a sniper's rifle with a tiny caliber or troublesome flickering flashing light, etc.

Thus, in the period that preceded the invention which is the subject matter of this application, as a rule, army units that were required to cope also with the challenges of using solely reasonable force, had to provision also an additional variety of NLW that replaces the lethal fighting means of their routine equipment, Moreover, the additional variety of NLW mandates also that they should be separately transportable (in bulk mode) to the conflict area, and assigning fighters with expertise in each type of this equipment separately, for being operated by them. The phenomena of decentralization (dispersion) of the NLW that we pointed at above, leads naturally to superfluous excess exposure of the fighters in the conflict areas to confrontations that might be violent, and to operational failures, such as lack of power concentration, lack of immediate and parallel availability of the variety of NLW and lack of accuracy (precision) in operating the means.

In parallel to the current spread of Low Intensity Conflicts (LIC) and Operations Other Than War (OOTW) type of conflicts, a "Remote Controlled Weapons Station" (RCWS) was added to the lethal fighting means of the ground army. RCWS is a weapons station that is mounted on military vehicles or armored combat vehicles, and is remotely controlled from inside the vehicle by means of a joystick, video display and an operating console. The RCWS comprises all the functions which enable it to acquire targets, aim the weapon and fire at a target with high accuracy. The gunner operates while he is within the vehicle and is protected by the vehicle's armor.

Figure 2:
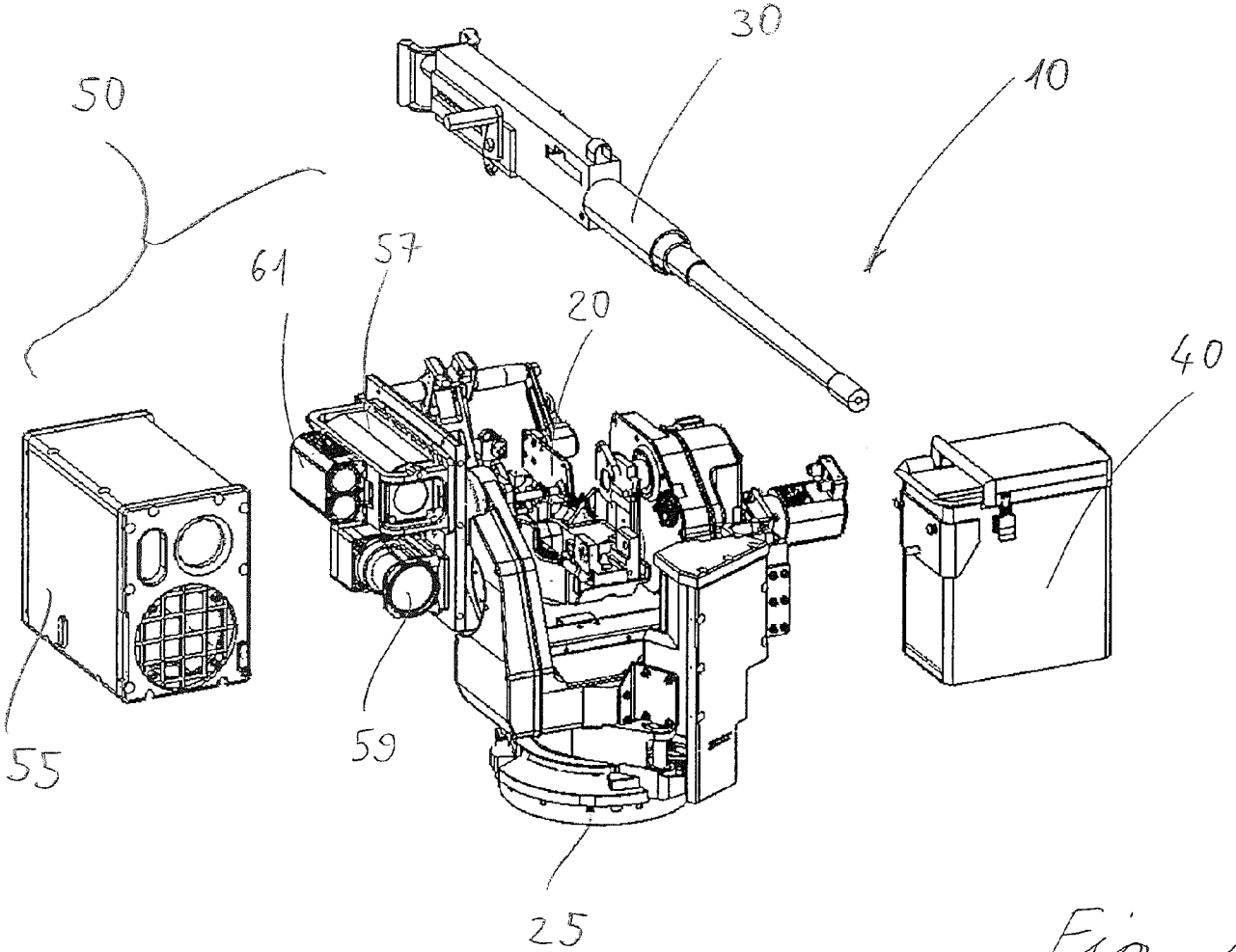

As an example for RCWS and for the sake of clarifications, reference is made to FIGS. 1 and 2. The figures depict in perspective an example of a representative RCWS 10 and an exploded view of an RCWS 10 (respectively), in a manner that makes it possible to learn about its characteristic assemblies—a weapon mounting bracket 20 that is pivotally mounted on a rotatable turret assembly 25 (that is suited on its side to be mounted on a vehicle (that is not illustrated)), so that the weapon mounting bracket has combined capabilities of complete rotation of 360° and an accurate mechanical elevating/lowering (by an assembly of controlled servo motors (that is not illustrated)), lethal weapons means 30 that is adapted to dismantling installation on weapon mounting bracket 20 (in the illustrated example—a heavy machine gun Browning M2, but it is also possible to mount (install) on the RCWS a variety of other weapons, as for example a MAG machine gun, a grenade's machine gun, an automatic cannon, canisters tube of anti-tank missiles), an ammunition crate 40 for "feeding" weapon means 30 and an electro-optical assembly 50 (including protective cover 55) that may include observation and sensing means, such as an imaging sensor ("camera") CCD 57, night observation means by thermal imaging (FLIR) 59 and laser range finder 61.

Thus, in the fighting means arsenal of army units there is already embedded means that has capability to accept and have installed on it and provide accurate remote operating of a variety of lethal weapon means. Namely—the means have capability of accurate mechanical rotation and elevating/lowering (as needed for aiming to a target in the wide open space around it and also continued tracking of it), it enables absorbing the recoil that is involved in operating pyrotechnical means from it (such as firing (shooting) blank cartridges for producing launching pressure and the like), it provides for electrical operation (actuating) mechanical mechanisms that are installed on it (as required for executing remote operations of cocking (guns etc.), pressing the trigger etc.). Means that provide for accurate day and night vision and aiming capabilities, and that is mobile (portable) and mounted as said on a vehicle, and controlled from the inside of the vehicle, and by this prevents dangerous exposure to enemy fire of the soldiers operating it.

At this state of affairs, as existing in the period preceding the invention which is the subject matter of this application, the same army unit itself, at a proximity of time and place, might be thrown into different operational scenarios, wherein when one exists—it is able to exploit for its benefit the advantages provided by the RCWS in its possession, while that from the instant wherein the second scenario occurs (e.g.—crowd control, scattering of demonstration and the like), as there is no alternative (i. e., due to lack of selection), the same army unit departs from exactly these advantageous capabilities.

In the one scenario, the army unit is exposed to a scenario that mandates using lethal weapons (for example—encounter with the enemy in an ambush), and because of the RCWS in its arsenal it can be mobilized quickly and to counter the enemy, focused and effectively, with a substantial and varied firing power, while its fighters are relatively defended inside the vehicle or the armored combat vehicle.

In the second scenario, the same army unit, is summoned to quell a demonstration and there it is required (ordered) in this case to exert only reasonable and not lethal force for this mission, and the advantages of its RCWS are not materialized (if at all—only for observation activities).

The troops are required to mobilize into the incident area a whole variety of the non-lethal means that they have in bulk state, to be spread in the area wherein they are exposed and hence vulnerable, and try to aim the means in the best effective way subject to their manual expertise.

Thus, in the period that preceded the invention, the subject matter of this patent application, there existed the need for means that would enable dispersing demonstrations or processions from the security of being inside a vehicle, by operating accurately all the scope of the variety of the non-lethal means that were mobilized into the area, in a centralized fashion and available for immediate action.

SUMMARY OF THE INVENTION

The invention, the subject matter of this application, responds to the unmet need described above, by conversion of a Remote Controlled Weapon Station (RCWS) to a "remote controlled Non-Lethal weapon station" (herein after—RCNLWS), including in a way of providing the RCWS with dual use capabilities, by temporarily disassembling a lethal weapon from an existing RCWS and utilizing the same RCWS this time, as an available and immediate basis for rather mounting a NLW on it and operating the NLW by it.

In one aspect of the invention, the invention is an RCWS that comprises as usual—a weapon mounting bracket, being remotely controlled for accurate elevating/lowering, and a rotatable turret assembly adaptable for being mounted atop of a vehicle and capable of remotely controlled accurate rotation, and wherein on the rotatable turret assembly the weapon mounting bracket is pivotally mounted. Thereby, in accordance with the invention, the RCWS is convertible into an RCNLWS and is characterized by that there is mounted in it at least one non lethal weapons means from a group consisting of a multi-barrels means for firing grenades, a multi-barrels launcher means for pyrotechnically firing a plurality of charges; for producing (noisy) sounds; lighting means; observation means; and means that provide sniper firing capabilities of a small caliber kinetic bullet.

In a second aspect of the invention, there is embodied in it a general method for operating a non lethal weapons means. A method that comprises the steps of providing RCWS that comprises a weapon mounting bracket amenable to be remotely directed in the elevating/lowering direction and a rotatable turret assembly suited to be mounted on the top of a vehicle and capable of being remotely directed in rotation, and wherein on the rotatable turret assembly the weapon mounting bracket is pivotally mounted. The second step of the method comprises the mounting, singularly or as a combination, of at least one non lethal weapons means selected from a group consisting of a multi-barrels means for firing grenades, observation means and means that provide sniper firing capabilities of small caliber kinetic bullet, on the weapon mounting bracket in a manner that instills combined directing (aiming) capabilities of rotation and elevating/lowering of the non-lethal means.

It is to be understood that both the foregoing general description and the following detailed description are exemplary and explanatory and are intended to provide further explanations of the invention as claimed.

BRIEF DESCRIPTION OF THE ACCOMPANYING FIGURES

Examples illustrative of embodiments of the invention are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale.

FIG. 1 constitutes, as said, a view in perspective of a typical (characteristic) RCWS.

FIG. 2 constitutes, as said, an exploded view of the RCWS that was illustrated in FIG. 1, in a manner that depicts its various assemblies.

Figure 3:
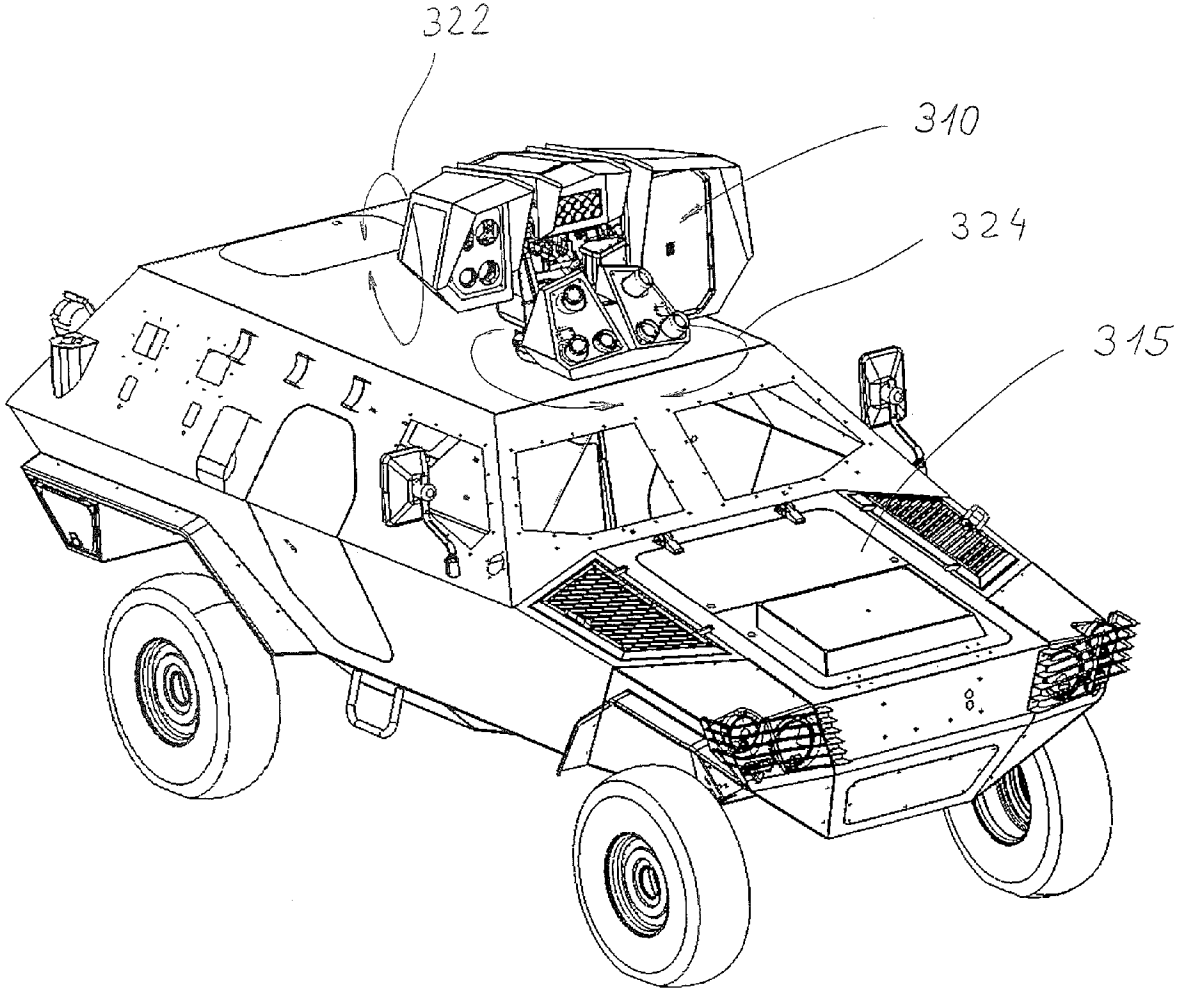

FIG. 3 constitutes a view in perspective of an example RCNLWS in accordance with the inion, as it is mounted on a vehicle.

Figure 4:
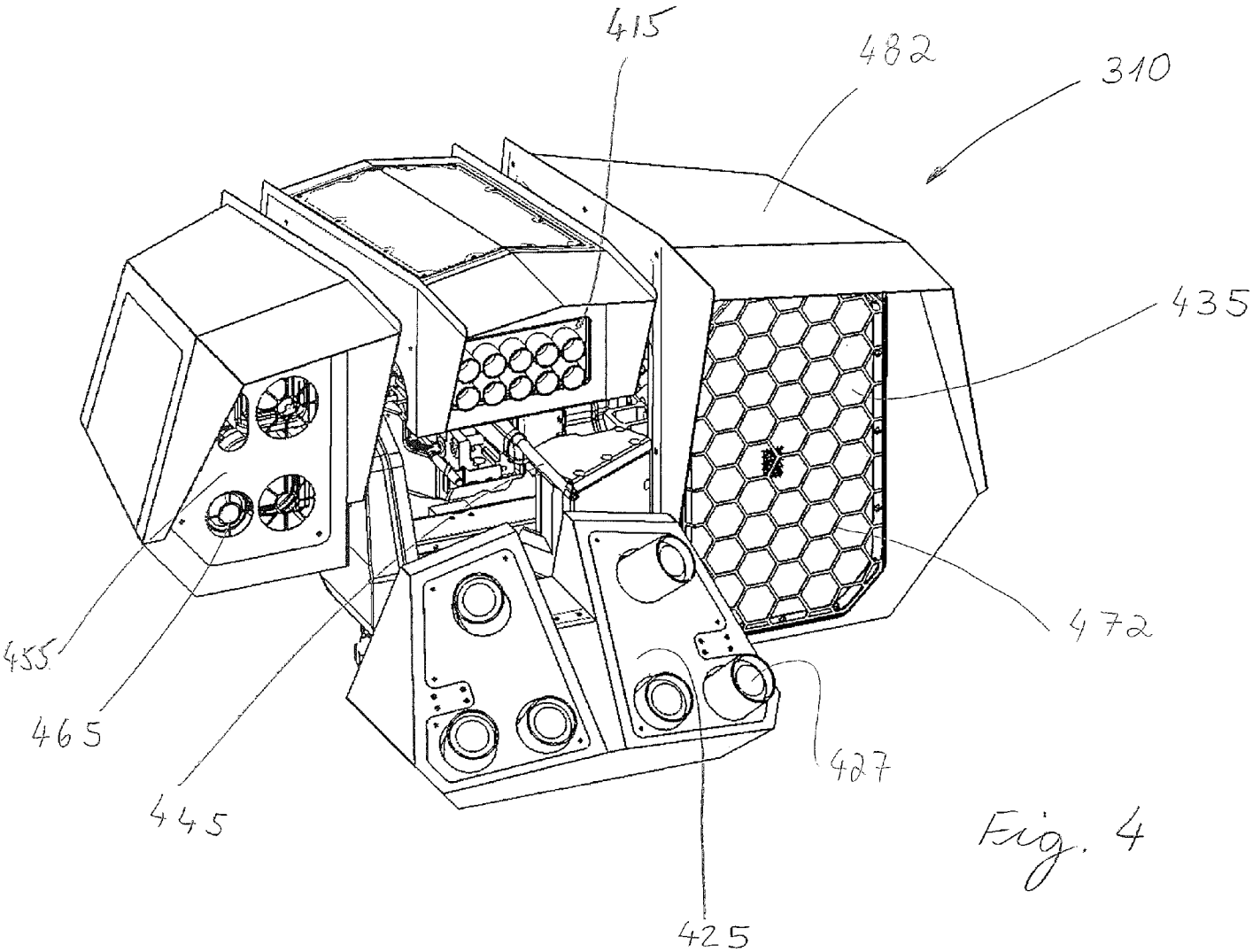
Figure 4A:
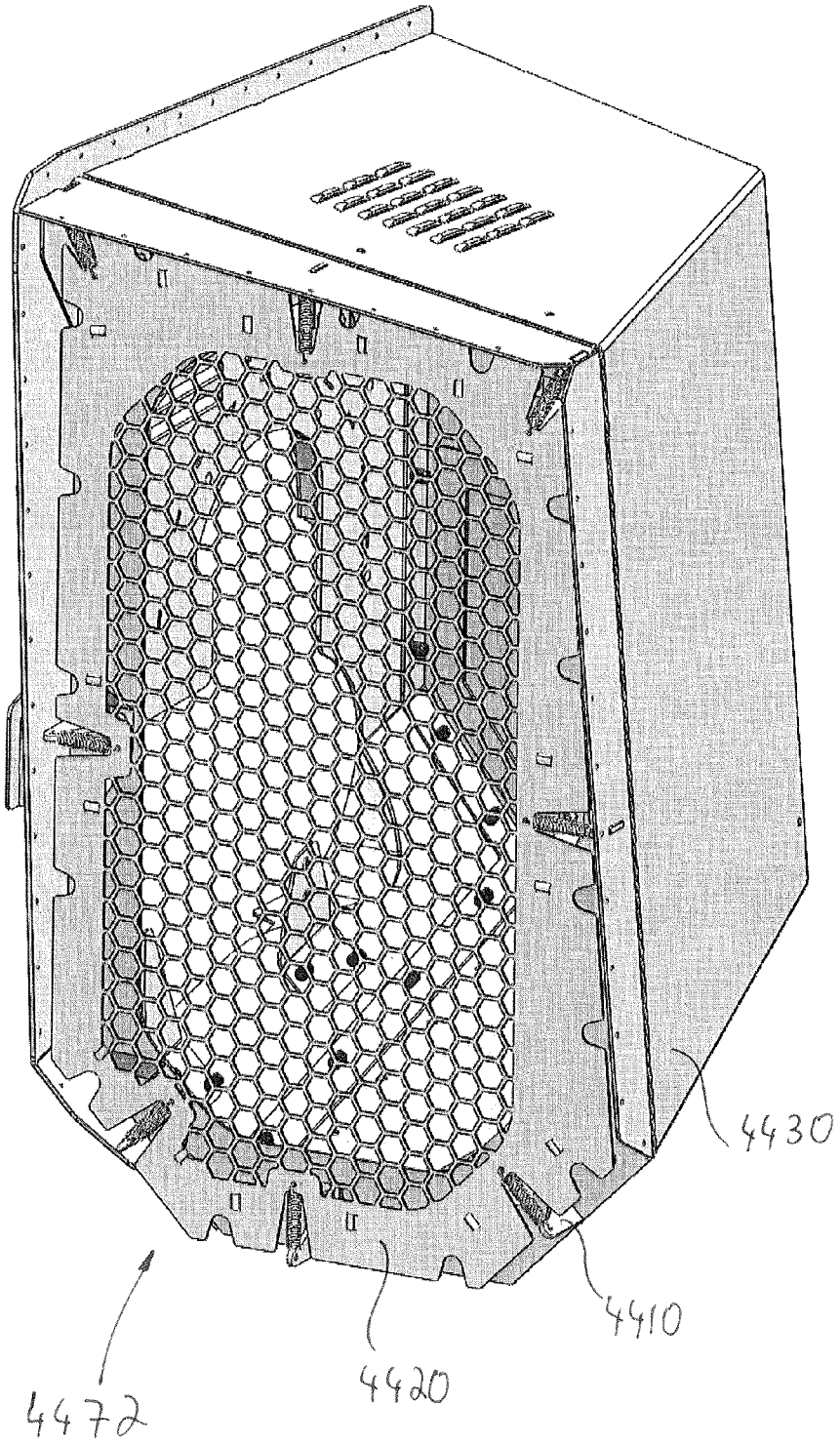
Figure 4B:
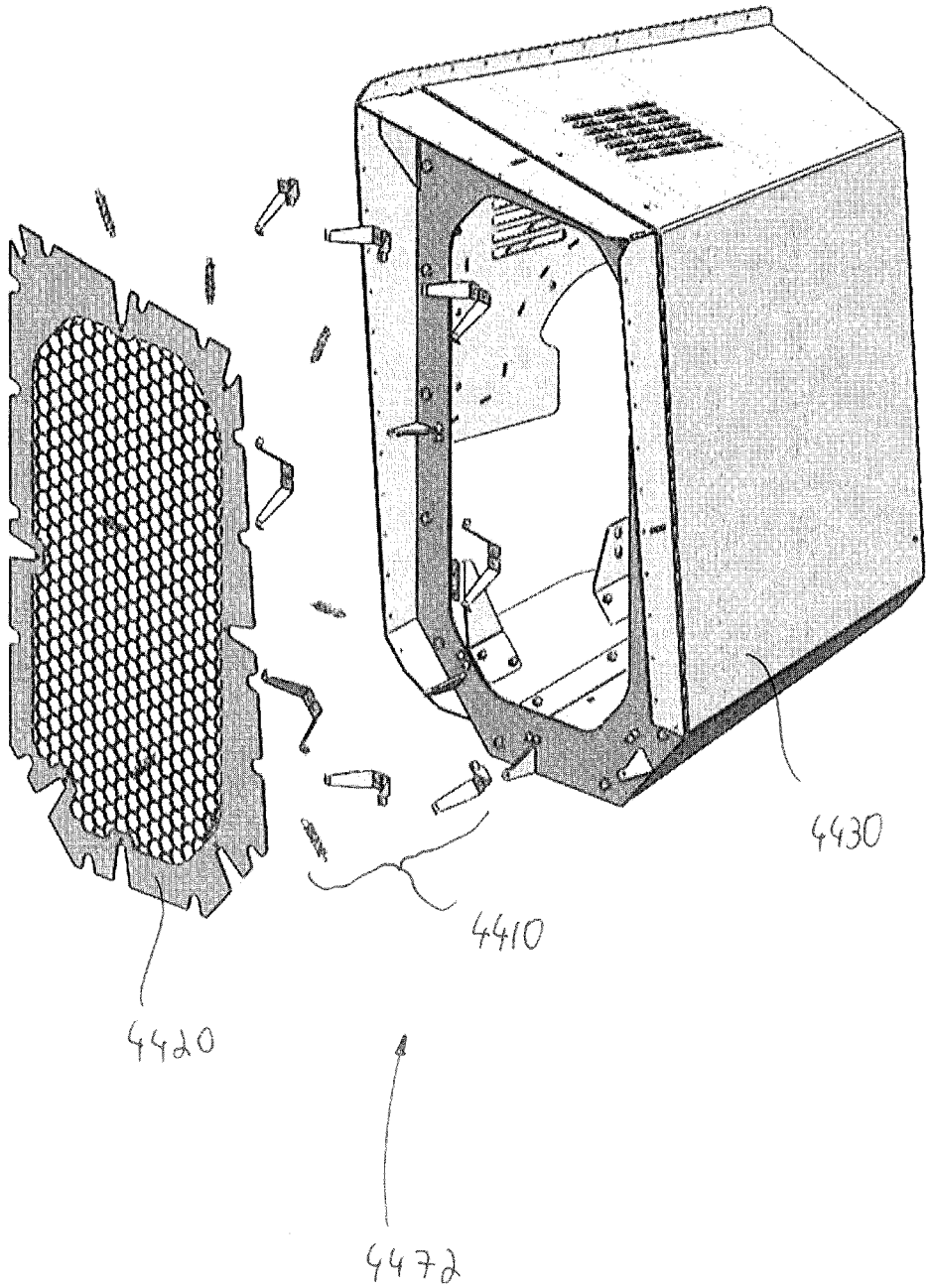

FIG. 4 constitutes a view in perspective of the RCNLWS that was illustrated in FIG. 3.

FIGS. 4*a* to 4*d* constitute views in perspective of (respectively)—protection means assembly, exploded view of the assembly components, a near view of a typical means for a damped affixing of the protection net component in said protection means assembly and a near view depicting the affixing method utilized in the affixing of the protection net to the affixing means.

Figure 5:
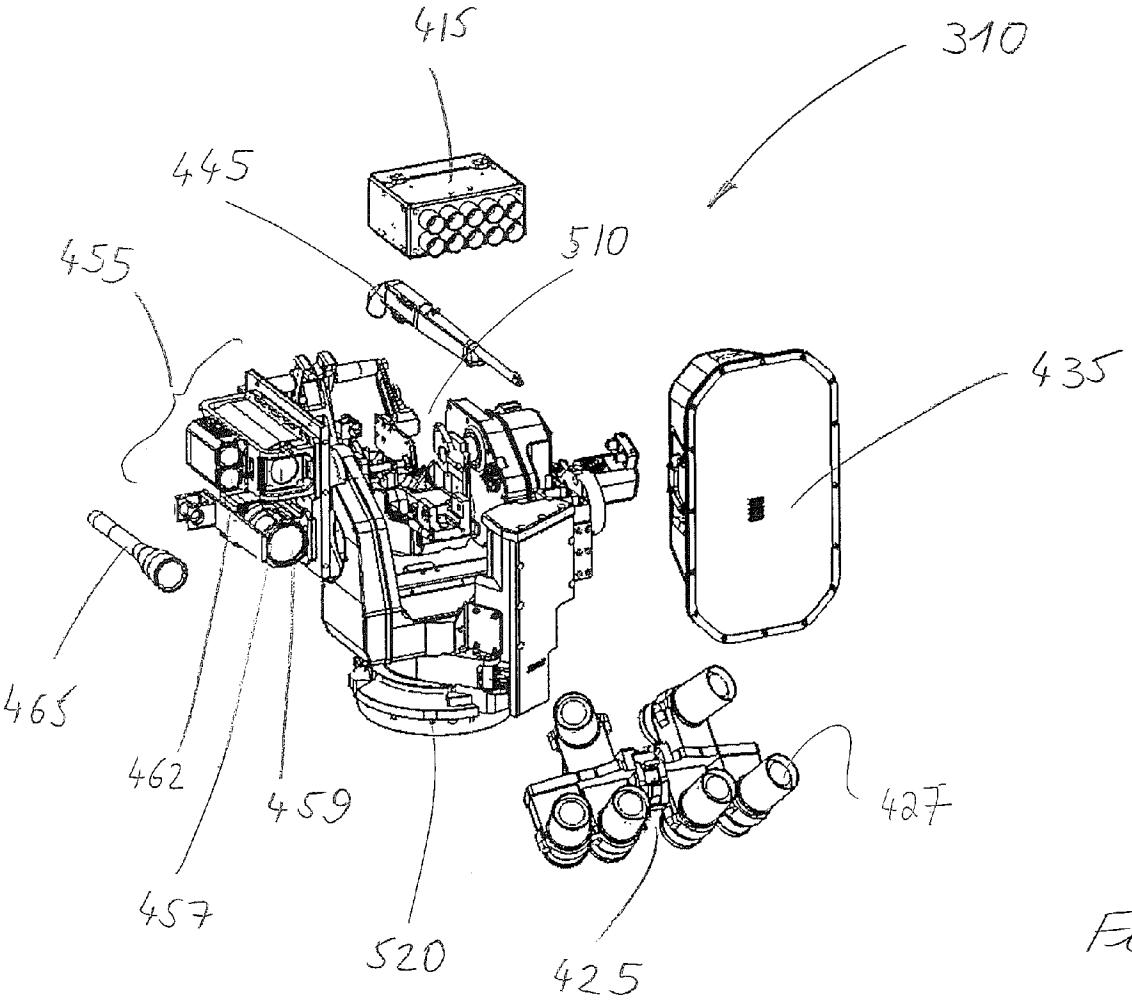

FIG. 5 constitutes an exploded view of the RCNLWS that was illustrated in FIGS. 3 and 4, in a manner that depicts its various assemblies (without protective and coverings means).

Figure 6:
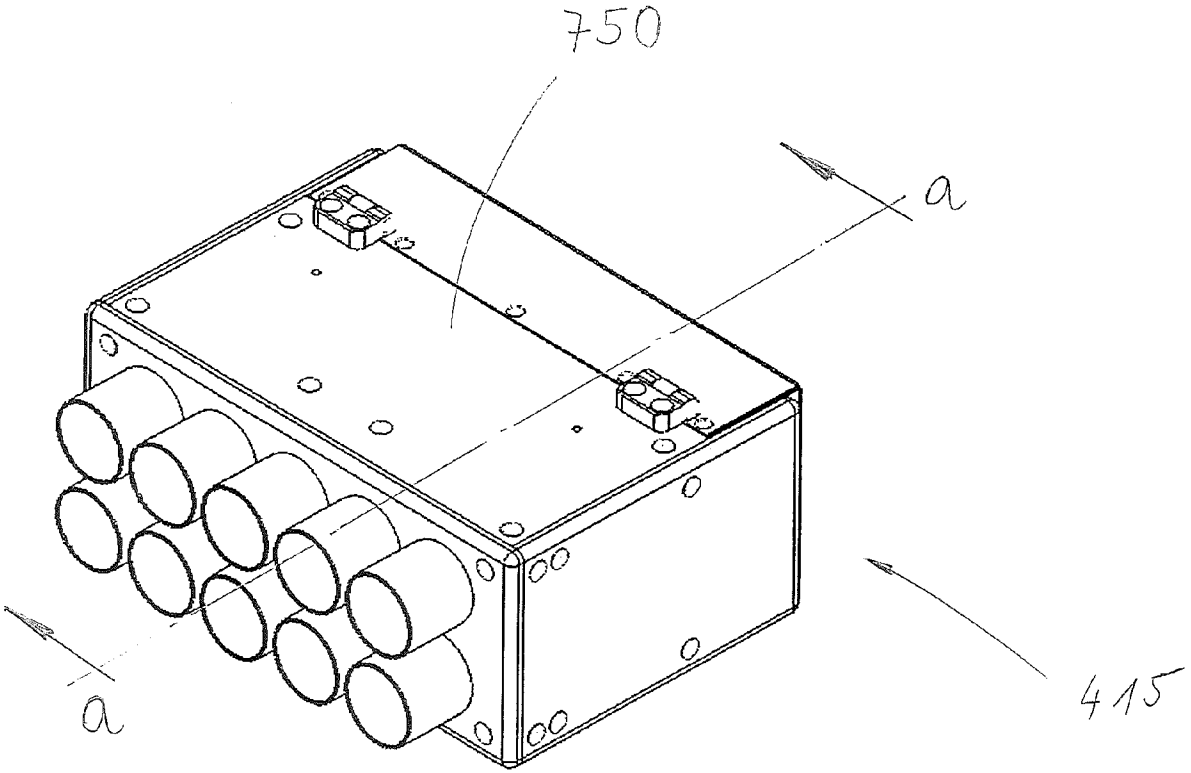
Figure 7:
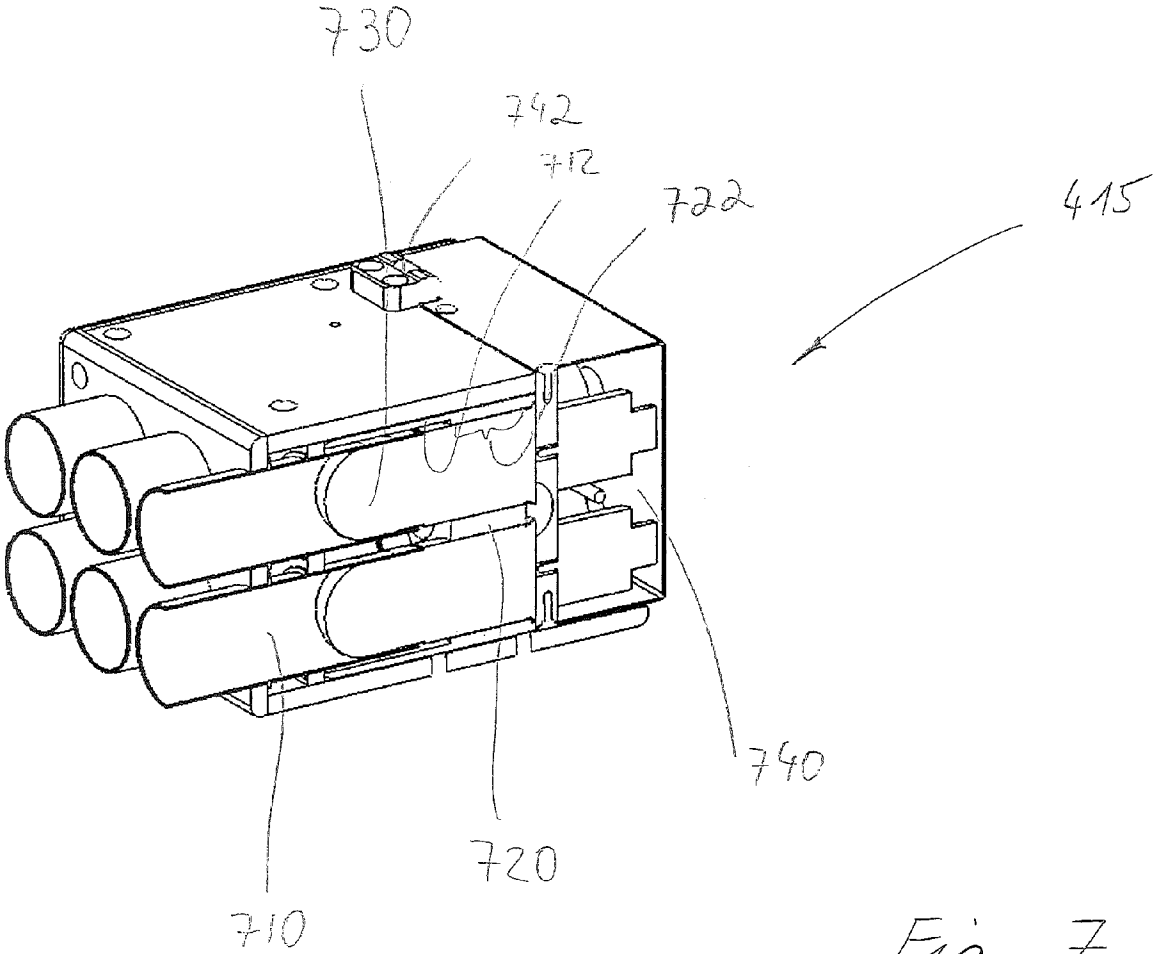

FIG. 6 constitutes a view in perspective of a multi-barrels means for firing grenades that is mountable in an RCNLWS in accordance with the invention, FIG. 7 constitutes a view in perspective of the multi-barrels means for firing grenades as viewed in cross section a-a that is marked in FIG. 6.

Figure 8:
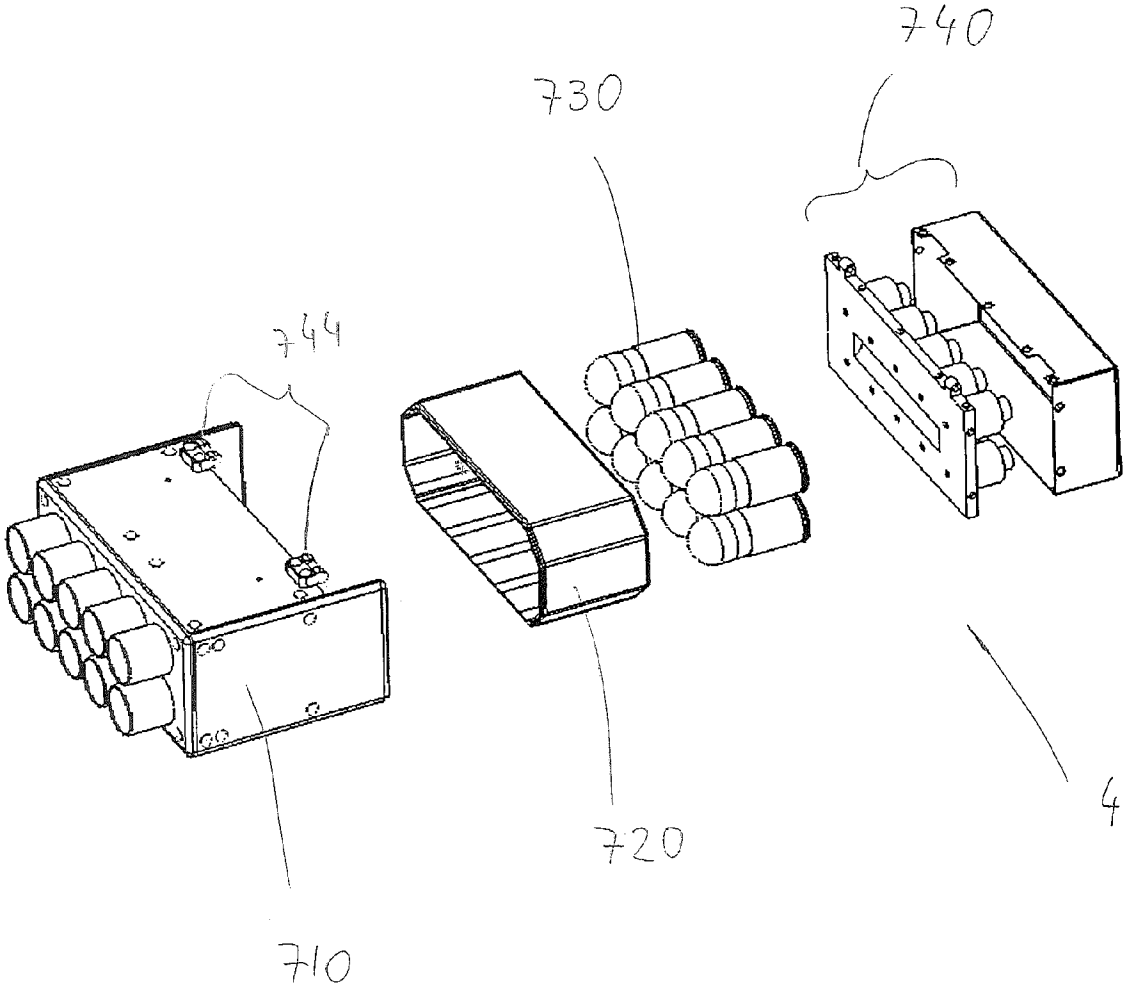

FIG. 8 constitutes an exploded view of the multi-barrels means for firing grenades that was illustrated in FIGS. 6 and 7, in a manner that shows its various assemblies (wherein the grenades are depicted outside its magazine assembly).

Figure 9:
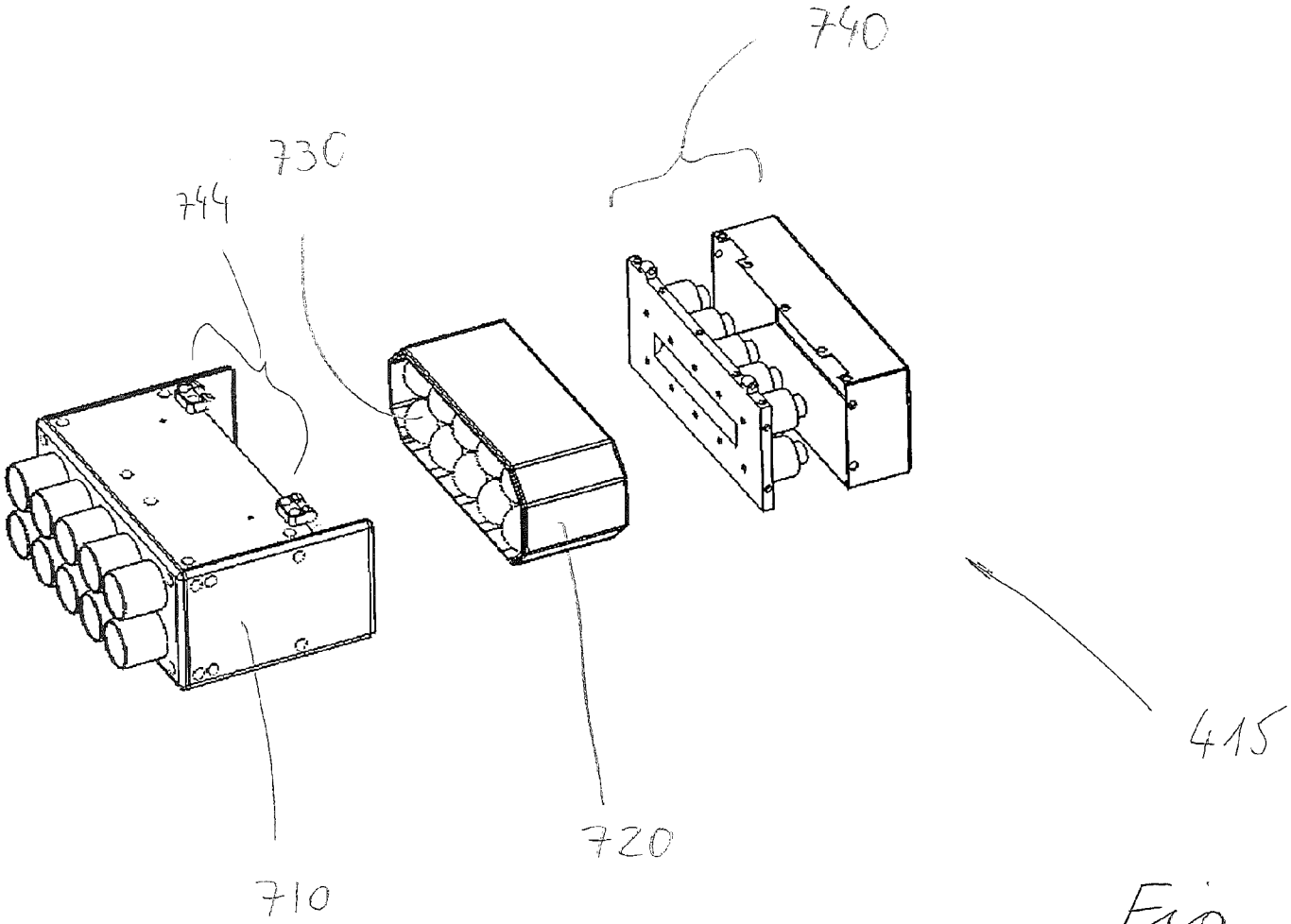

FIG. 9 constitutes an exploded view of the multi-barrels means for firing grenades that was illustrated in FIGS. 6 to 8, in a manner that it shows its various assemblies (wherein the grenades are included inside its magazine assembly).

Figure 9A:
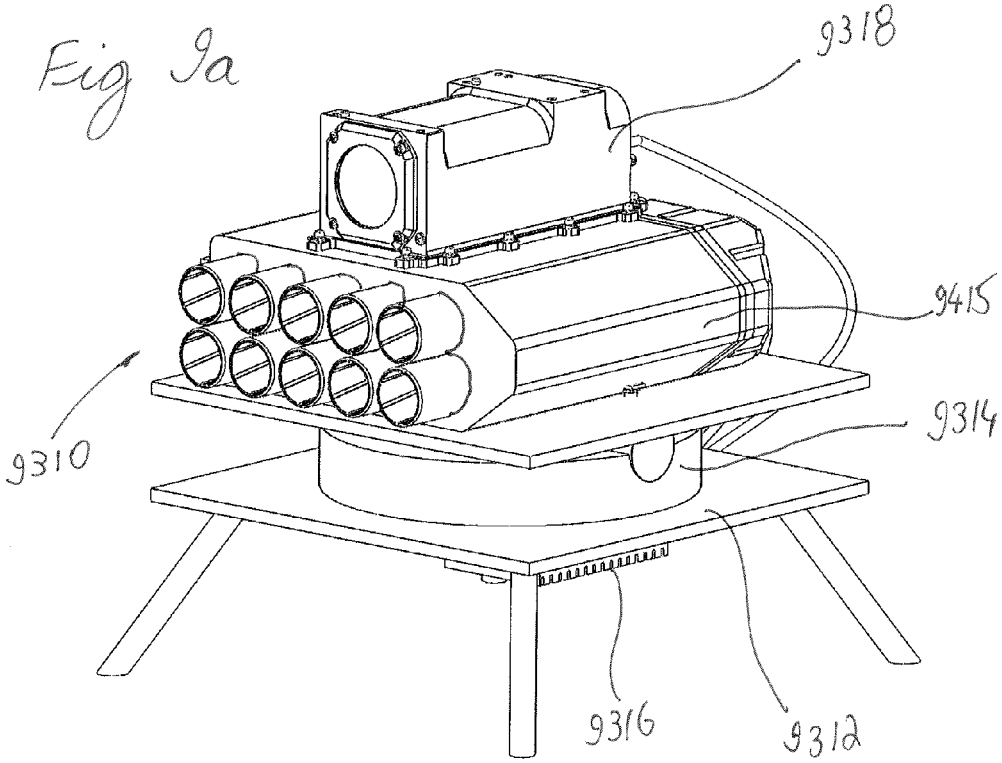
Figure 9B:
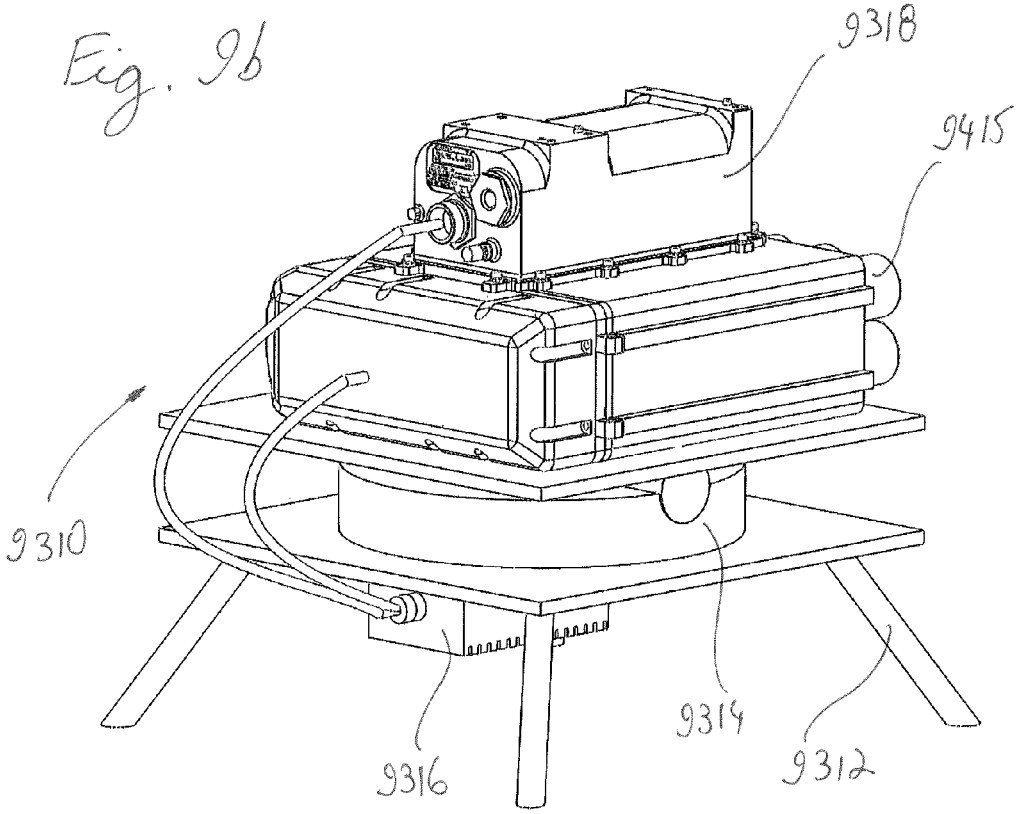

FIGS. 9*a* and 9*b* constitute views in perspective from two different angles of the multi-barrels means for firing grenades that was illustrated in FIGS. 6 to 9 wherein it is implemented on an adjustable tripod and not as a part of an RCNLWS being installed on a vehicle.

Figure 10:
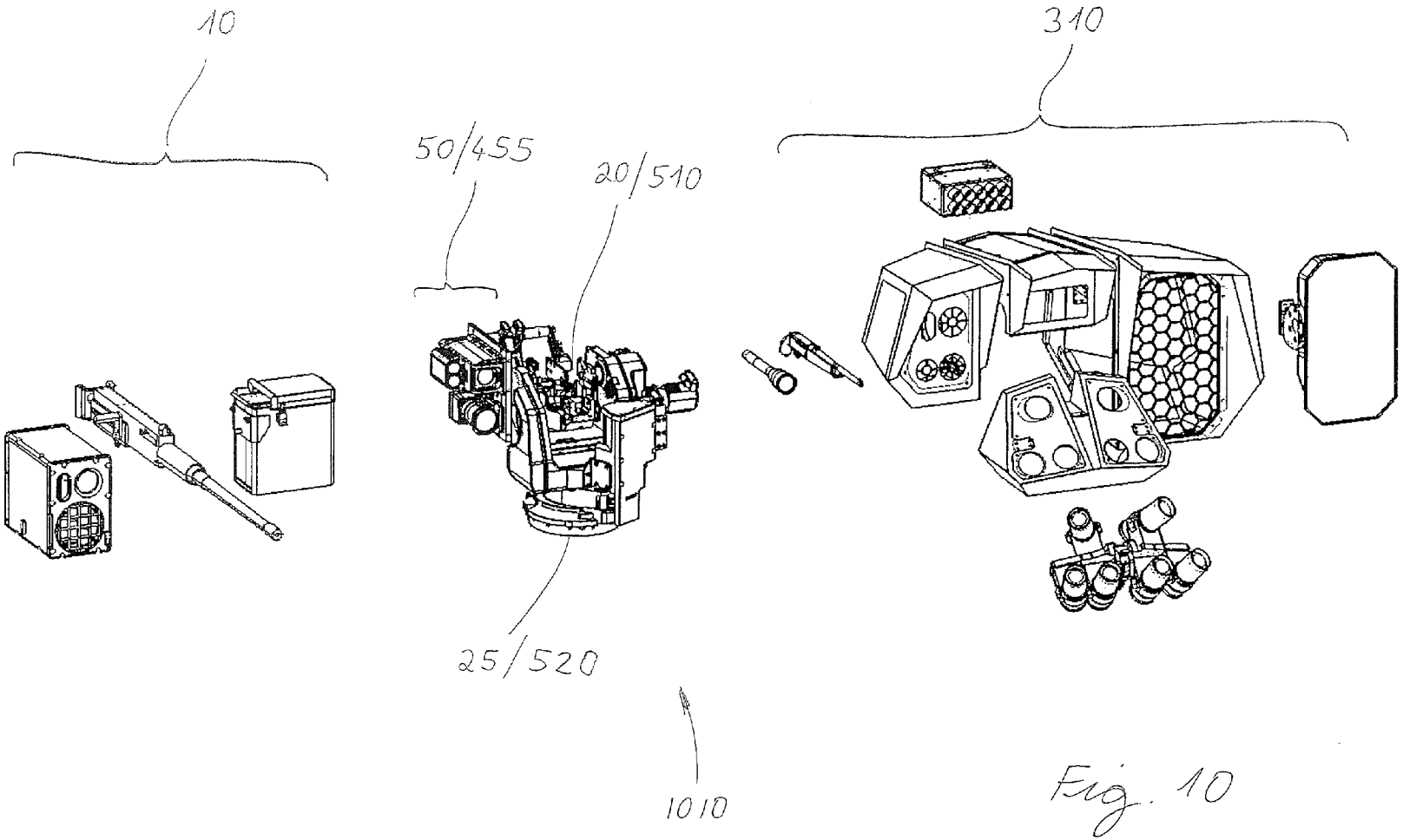

FIG. 10 constitutes a view in perspective of an RCWS equipped with a rotatable turret assembly and a weapon mounting bracket that is suited for alternate mounting of a lethal weapon means or (alternatively) non lethal means, in accordance with the invention.

DETAILED DESCRIPTION OF A CONFIGURATION EXAMPLE OF THE INVENTION

Reference is being made to FIGS. 3 to 5. FIG. 3 constitutes a view in perspective of an example RCNLWS 310 in accordance with the invention, as it is mounted on a vehicle 315 (in the illustrated example—a wheeled type armored vehicle, but any professional would understand that it is spoken only of an example, and RCNLWS 310 can be mounted on one of a variety of different wheeled or tracks base vehicles, armored or non-armored. FIG. 4 constitutes a view in perspective of RCNLWS 310. FIG. 5 constitutes an exploded view of RCNLWS 310, without protective and coverings means, and in a manner that it shows its various assemblies, in the illustrated example—a multi-barrels means 415 for firing grenades, a multi-barrels launcher means 425 for pyrotechnically firing plurality of charges; acoustic means 435 (in the illustrated example a loudspeaker for voicing verbal messages and tones), means 445 that provide sniper firing capabilities of small caliber kinetic bullet (in the illustrated example—a remotely operated snipers rifle with a tiny caliber for firing kinetic bullets), observation means 455 (in the illustrated example an assembly that includes an array of CCD Camera 457, thermal imaging means 459 and laser range finder means 462), and illuminating (lighting) means 465 (in the illustrated example—a powerful high intensity spot-light/projector).

As typical in RCWS systems, also RCNLWS 310 is based on a weapon mounting bracket 510 that is remotely controlled and directed (aimed) in the elevating/lowering plane (see in FIG. 3 arrow 322), for example elevating to 60° and lowering to −20°. Weapon mounting bracket 510 is pivotally mounted on a rotatable turret assembly 520 that is suited to be installed (mounted) on vehicles, and is remotely controlled and directed (aimed) at the siding plane (see in FIG. 3, the arrow 324) in (the whole) 360° rotation.

In the illustrated example, the combined implementation of the multi-barreled means 415 for firing grenades, the illumination means 465 and means 445 for providing sniper firing capabilities of small caliber kinetic bullet, is done on weapon mounting bracket 510, in a manner that it instills combined aiming capability in rotation and elevating/lowering of these means accurately towards the target.

The multi-barreled means 415 for firing grenades, about which we shall elaborate below, when referring to FIGS. 6 to 9, is being characterized by a honey-comb like array of several launching barrels one next to the other. Namely, reference is made to an available inventory item of a number of launching barrels for firing grenades, wherein all of them can be trained accurately together unto a single target. As was explained above (in the background of the invention chapter), grenade ammunition for non-lethal applications (for example 40 mm cluster bombs ammunition of rubber balls, plastic balls, salt packages. paints etc.) does not enable repeated coking of an automatic firing means (in multi-cartridges bursts) of a grenades machine gun, and the solution that was selected for it of posting a beehive array with multi-barrels layout, overcomes this difficulty by posting, as said, a number of launching barrels on the weapon mounting bracket that is accurately trained (both and combined in the rotation and in the elevating/lowering planes) towards the target.

Concurrently, any professional would understand that it is feasible to position another and different means that enables grenades firing in a continuum (multi-cartridges bursts), for example—grenades' launcher, one or more, with a revolving feeding "drum" of many grenades (in a manner that enables a continuum feeding of grenades into a single barrel).

Means 445 for providing sniper firing capabilities of small caliber kinetic bullet that is illustrated as an example in the figures, is as said a rifle with a "tiny" caliber, that can be remotely cocked and fired by electrical control (for example a caliber 0.22" rifle), but any professional would understand that in the same way as for this rifle, it is also possible to implement another rifle, for example—shotgun, or a shooting weapon that enables to change, in the field, a change as per the will of the user—the kinetic energy given to the projectile, or a gun for shooting arrows that are connected by electrical wires to a low voltage source.

Any professional would also understand that from the optical point of view, it is possible to combine the image viewed through the sight device of means 445 with a visual display that is usually displayed to the eyes of the RCWS operator (for our exposition—the RCNLWS operator), on the display panel located inside the vehicle as part of the RCWS operating console.

Illuminating (lighting) means 465, in the illustrated example, is a high intensity spot light (flash light) that operates in the visible spectrum and can also serve for blinding the target, but any professional would understand that similarly the illuminating means is liable to include—as an alternate or added item also means for dazzling (temporarily blinding) by a laser beam or a blinking device operating in frequencies that are known to irritate people (the human's eye).

Observation means 455 that is illustrated solely as an example, is the same camera, FLIR and laser range finder payload that is also installed in an RCWS with lethal weapons, but any professional would understand that it is possible to designate for being mounted in an RCNLWS, other and different electro-optics payload (for example—a striped down type of a payload with reduced capabilities, and hence lower costs, from those required for RCWS equipped with lethal weapons).

In the illustrated example, besides the combined mounting of the multi barreled means 415 for firing grenades, the illuminating (lighting) means 465 and the means 445 for providing sniper firing capabilities of small caliber kinetic bullet, on weapon mounting bracket 519, in a manner that instills a combined capabilities of rotation (lateral movement) and accurate elevating/lowering those means, mounted in RCNLWS 310 also additional means that enables their training in the siding (rotational) plane accurately towards the target—multi-barrels launcher means 425 for pyrotechnically firing plurality of charges; and acoustic means 435.

Multi-barrels launcher means 425 for pyrotechnically firing plurality of charges that is illustrated as an example in the figures, includes an array of a of tubular mountings 427 arrange in an angular sector, that are suited to accommodate in them a variety of pyrotechnically launched charges—for example tear-gas, smoke, or shock grenades, balls containing cluster charges, and their pyrotechnically launching them to the target by electrical actuating. In the illustrated example, the array of tubular mountings 427 is positioned on rotatable turret assembly 520, wherein the mountings are tilted at a constant angle, and thus enables to train them to the target only in the siding (rotational) plane. Any professional would understand that it is spoken only of an example, and that it is possible to instill in such multi-barrels launcher means also a elevating/lowering capability (for example—by mounting it on the on the pivotally moveable weapon mounting bracket or by equipping it with an additional and designated elevating/lowering means).

Acoustic means 435 that is illustrated as an example, is a loudspeaker for producing a tone in the human's hearing spectrum (for example—issuing orders to the protesting crowd, raising a screeching sound) that is also mounted on the rotatable turret assembly 520, in a manner that enables training it in the (rotation) siding plane. Any professional would understand that the acoustic means can include—in parallel to such loudspeaker or instead of it, other and different acoustic means, for example—means that transmits audio waves in an intensity or frequency that causes non pleasant feeling or even hurting, head or ears ache, harming the hearing, nausea, confusion and hurting the internal organs resulting from vibrations caused by the noise or an especially very harsh loudspeaker (LRAD) that lets out a narrow band of strong tones that causes strong head ache that neutralizes people in up to 300 meters range. Thus it is also possible to instill on the acoustic means ability to act in raised or lowered planes (for example—by mounting it on the pivotally moveable weapon mounting bracket or by equipping it with an additional and designated elevating/lowering means).

Any professional would also appreciate the fact that the variety of non-lethal means that were detailed hereinabove when referring to RCNLWS 310 or as an alternate or added to them, can actually include the majority if not all known non-lethal means as well as those that are currently only in the development stage.

There is no need to exaggerate in description words relating to the fact that an RCNLWS might be confronted by violent reaction from its potential targets (for example—the demonstrators), and this might happen in short ranges relative to it. This reaction, that is apt to include for example—attacks by throwing stones, rocks and incendiary "Molotov Cocktails" (bottles) to and on the RCNLWS, can hit the RCNLWS and the means mounted on it. Hence, as can be seen in FIG. 4, RCNLWS is liable to include in addition, also an array of protecting and covering means.

In the illustrated example depicted in FIG. 4, RCNLWS 310 includes in addition protection means 472 on the front of the loudspeaker (acoustic means 435), that is illustrated there as an example. Protection means 472 instills ability to push away objects that might be thrown to the loudspeaker's front. In the illustrated example, protection means 472 is an elastic protection item (in the illustrated example, in the configuration of a net), that is able to bend temporarily when an object hits it and then pushes it away. Other protection means can include a net made of polymeric material or an array of stretched cables that is relatively flexible, for example due to springs at their ends. Any professional would understand that it is possible to install such protection means on the front of observation means 455 too.

As a specific example, reference is made to FIGS. 4*a* to 4*d*. The figures constitute views in perspective of (respectively)—an example of protecting means assembly 4472, an exploded view of assembly 4472 components, a near view of a typical means 4410 for a damped affixing of the protection net component 4420 in protection means assembly 4472 and a near view depicting the affixing method utilized in the affixing of the protection net to the affixing means.

In accordance with the illustrated example, protecting means assembly 4472 is liable to include a protecting net 4420, plurality of affixing means 4410 and protecting covers in a configuration of a cabin 4430 with a front opening. A cabin in which there may (can) be included audio visual means such as for example cameras, a loudspeaker and the like, assemblies that it is desired to protect from being damaged.

Protecting net 4420 is manufactured, for example, from stainless steel wherein it is formed with openings that on the one hand they enable the regular operation of the means which are meant to be protected and on the other hand (they are meant) to prevent passage through them of articles (objects) that are liable to be hurled at the RCNLWS when it is being attacked (for example, stones and rocks, Molotov cocktail bottles and the like).

As said, protecting net 4420 is meant to be momentarily bendable from the instant of being hit by the hurled articles and continues to repel it backwards. In the illustrated example, this capability is instilled on the net through its "floating" affixing on an array of plurality of affixing means 4410 that do affix the net component unto the front opening of cabin 4430 in a damped manner. In the illustrated example, a typical affixing means (see FIG. 4*c*) includes a couple of leaf springs 4412 and 4414 that are located one next to the other (in tandem) and anchored (in the illustrated example, by screws) unto the rim (edge) of cabin 430 front opening. A protruding tab 4416 that in the illustrated example is formed as an integral part of the rim of cabin 4430 front opening serves as a basis for anchoring (harnessing) of a spiral spring 4418. From the instant of installing protecting net 4420—the net is affixed unto the assembly through a circumferential array of such affixing mans (see FIGS. 4*a* and 4*b*). In each one of the affixing means, the net leans by its back against a couple of cited above leaf springs and is anchored through said spiral spring to the cabin (see FIG. 4*d*). Thus, any professional would understand that through this manner, there is instilled unto the net the capability to absorb a blow from an article that is hurled against it and to repel it. Any professional would also appreciate the fact that implementing protection means such as those introduced by assembly 4472 that was described above, are liable to prevent breakage and shattering of thrown articles (such as Molotov or paints bottles) from the instant they hit the RCNL. WS and thus to improve without bounds the capability of continued service of the sensitive instruments that are operated on this platform.

More about the needs of protection means, in the illustrated example depicted in FIGS. 3 and 4, RCNLWS 310 includes in addition an array of protecting coverings 482 that can divert away burning liquid thrown at it, and leads the burning liquid faraway from the means mounted on it. Any professional would understand that protecting coverings 482 are characterized by a tilted (inclined) positioning and at times by providing the means with small roof-like caps (see atop of multi barreled means 415, acoustic means 435 and observation means 455) that divert the liquid flow, as said.

All this and more. Protective coverings 482 are liable to be painted on their external side by liquids repelling paints, in a manner that it is likely to contribute to sliding and removal of the paints liquids or fire even as they are thrown on or hurled at the RCNLWS. Such a paint is liable to be for example a material that is known by its commercial name "Ultra-Ever Dry". Ultra-Ever Dry is a superhydrophobic (water) and oleophobic (hydrocarbons) coating that will repel most water-based and some oil-based liquids. Ultra-Ever Dry uses omniphobic technology to repel water, some oils, wet concrete, and other liquids.

Any professional would also understand that it is feasible to convert the control and display operating console of the RCWS so that it would also suit the needs of the RCNLWS. Moreover, it is possible to add to it recording means for real time recording of the display produced from the observation means and of the audio produced by the acoustic means (as required at times for documentation requirements, identifying suspects, and in the framework of the media "battles" that arises, as usual, following such violent confrontations). In addition to it or alternatively, any professional would understand that it is possible to operate the non lethal means by an add-on specific (dedicated) electronic control system while only exploiting the mechanical means and capabilities of the RCWS.

Reference is made to FIGS. 6 to 9. FIG. 6 constitutes a view in perspective of a multi-barrels means 415 for firing grenades that is mountable in an RCNLWS in accordance with the invention (see above and when referring to FIGS. 3 to 5, its mounting in an RCNLWS 310) as a solution to a need for a concentrated and relatively accurate aimed firing of several grenades to the target (in a continuum burst or even in one or more volleys) and while overcoming, hence, the inability of a non-lethal grenade cartridges to provide enough pressure as required in order to execute the repeated cocking operation of the grenade machine gun.

FIG. 7 constitutes a view in perspective of a multi-barrels means 415 for firing grenades in a-a cross section as marked in FIG. 6. FIG. 8 constitutes an exploded view of means 415 in a manner that shows its various assemblies (wherein the grenades are outside the magazine assembly), and FIG. 9 constitutes an exploded view of means 415 in a manner that it also shows its various assemblies (wherein the grenades are included inside the magazine assembly).

In the illustrated example, multi barreled means 415 for firing grenades includes multi barreled assembly 710 that in the illustrated example includes ten barrels positioned in a bee-hive-like configuration one next to the other. Any professional would understand that assembly 710 can include a different number of barrels as well as barrels that are positioned in a different layout (not only in two parallel lines as in the illustrated example).

Means 415 includes in addition magazine assembly 720 that is suited to include in it grenades 730 and to be installed inside multi barreled assembly 710, in a manner that it posts all the grenades in parallel, facing and suiting the barrels. Magazine assembly 720 is liable to be made of polymers material and formed with bracket sectors 722 that are suited to hold the grenades' cartridges. The grenades can be affixed to magazine 720 by a spring clasp (that is not illustrated).

Means 415 includes in addition a multi firing-pins assembly 740 that are electrically operable. Firing-pins assembly 740 is suited to be installed behind magazine assembly 720 and in a manner that post in parallel, all the firing-pins facing and suited to grenades 730. Any professional would understand that the firing-pins can be made to operate electrically by solenoid components and electronics' controlled for the striking action each one separately (by itself) in a continuum (in a different pace) all together (as a volley) or as volleys of only some of them.

Means 415 includes also a packaging and mounting assembly 750 that is suited to package assemblies 710, 720 and 740 as one unit that is mountable in weapon mounting bracket 510 (see above with reference to FIGS. 3-5) and in a manner that enables extracting magazine assembly 720 and inserting another one instead.

In the illustrated example, assembly 740 is connected to assembly 710 by hinge means 742 and an array of latches 744 that can be opened in a manner that enables moving assembly 740 and providing access to magazine assembly 720. Magazine assembly 720 is suited in its external dimensions to accurate mounting as required (facing and suiting the barrels) inside space 712 that is formed in assembly 710.

Loading means 415 is executed by opening latches 744 and turning (revolving) firing-pins assembly around the hinge axis. Thus access is enabled to the rear of magazine assembly 720. Magazine assembly 720 is extractable by pulling and therefore, instead of an empty magazine it is possible to insert a magazine assembly 720 full with grenades into space 712. From the instant of inserting the magazine, operator returns and turns firing-pins assembly 740 back to its place and closes latches array 744. At this stage, multi barreled means 415 for firing grenades is ready for renewed firing.

Any professional would understand that the continuum of unloading and renewed loading of multi barreled means 415 for firing grenades as was described above, is given to be executed relatively quickly and requires only minimal exposure of the operator (that also at this stage of unloading and renewed loading is left behind the RCNLWS 310 and required only to expose his hands (and at most the upper part of his body) from the relative cover provided by the vehicle compartment (that might be an armored vehicle). Moreover, the professional would also understand that is possible to implement a multi barreled means for firing grenades in accordance with the invention with a system that enables unloading and renewed loading with even lesser exposure and even inside the vehicle compartment (for example—by elevating to the maximum the weapon mounting bracket or by linearly conveying of the multi barreled means, at least partly, into the vehicle compartment after elevating it as said).

Any professional would understand that the multi-barrels means for firing grenades that was described above while referring to FIGS. 6 to 9, is liable to be integrated into means that are not necessarily RCNLWS. For example—as means for firing non-lethal armament from a tripod that is installed for defending a stationary post or from a tripod mounted in an aerial or naval platform that confronts with law and order breakers or law violators at the maritime arena or on the ground.

Thus for example, FIGS. 6 to 9, depict in perspective from two different angles a version 9415 of the multi-barrels means for firing grenades that was illustrated in FIGS. 6 to 9 wherein it is implemented on an adjustable tripod 9310 (and not as a part of an RCNLWS being installed on a vehicle. In the illustrated example, adjustable tripod 9310 includes a stand 9312 wherein on its top there is mounted means 9314 for providing the multi barrels means 9415 with lateral and elevation/lowering planes movement capabilities. In the illustrated example the multi-barrels means bearing may be commanded by a remote control transmission received through a communication unit 9316 that in the illustrated example it is also adapted to transmit backwards the given target arena sight (by using information and data that is received from a visual sensor 9318 that in the illustrated example is mounted on the multi barrels means top).

Reference is being made to FIG. 10. The figure constitutes a view in perspective of RCWS 1010 that comprises rotatable turret assembly and a weapon mounting bracket that in accordance with the invention are suited for alternate mounting in them of a lethal weapon or (alternatively) a non-lethal means. On the right hand side of the figure, is shown an exploded view of means that are installed in an RCNLWS 310 (and see above when referring to FIGS. 3 to 9); on the left side of the figure assemblies of RCWS are shown (and see above, in the Background of the Invention section and with reference to FIGS. 1 and 2). At the center of the figure weapon mounting bracket 20/510, rotatable turret assembly 25/520 and in the illustrated example—also an electro-optical assembly (observation means) 50/455), that are suited to be mounted in accordance to the needs—a non-lethal means or alternatively a lethal weapon, hence were tagged with numbers assigned on the one hand for the RCNLWS 310 and on other hand referring to RCWS 10.

Thus, any professional would appreciate the fact that the invention enables dual use or in other words—alternating configurations (versatile). Duality of switching from fighting (lethal weapons) to non-lethal state, and this through the simplicity of dismantling modules and mounting others in their place.

Any professional would also understand that the duality might exist when instead of the non-lethal means a rather lethal means is mounted that is not necessarily the heavy machine that was illustrated only as an example, but also other and different lethal weapon instead of the non lethal means (such as for example—a grenades machine gun, automatic cannon, a canister and in it a ready to be fired anti tank missile). Similarly, the duality can (still) exist when instead of the lethal weapons non lethal means are mounted that are not necessarily a multi-barrels means for firing grenades, a multi-barrels launcher means for pyrotechnically firing plurality of charges; acoustic means for producing (noisy) sounds; illuminating means; observation means and means for providing sniper firing capabilities of small caliber kinetic bullet, where all of them were illustrated solely as an example.

Moreover, any professional would appreciate the fact that in an RCNLWS in accordance with the invention; a general method is embodied for operating non lethal means that comprises the steps of— a. Providing an RCWS that comprises a weapon mounting bracket amenable to be remotely directed in the elevating/lowering direction and a rotatable turret assembly suited to be mounted on a top of a vehicle and capable of being remotely directed in rotation, and wherein on the rotatable turret assembly the weapon mounting bracket is pivotally mounted; and
b. Mounting, singularly or as a combination, of at least one non lethal means from a group consisting of a multi-barrels means for firing grenades, observation means and means that provide sniper firing capabilities of small caliber kinetic bullet, on the weapon mounting bracket in a manner that instills combined directing (aiming) capabilities of rotation and elevating/lowering of the non-lethal means.

A method for operating non lethal means in accordance with the invention may include also in addition, a preliminary step of dismantling lethal means from the weapon mounting bracket, so that alternate mounting of a non lethal means in it would be enabled, and so—switching in accordance with the needs of the RCWS into non lethal applications (turning it into an RCNLWS according to our definitions).

This and more, the method for operating non lethal means in accordance with the invention can also include, in addition, a step of mounting on the RCWS of at least one non lethal means from the group consisting of multi-barrels launcher means for pyrotechnically firing plurality of charges, acoustic means and observation means.

Thus, RCNLWS in accordance with the invention is liable to disperse demonstrations and processions by operating non lethal means from the relatively protected inside compartment of a vehicle and while maintaining an appropriate distance and avoiding physical contact with the demonstrators.

RCNLWS in accordance with the invention enables accurate and concentrated activation (operation) of a whole arsenal and variety of non lethal means, from one (single) platform that can be mobile (a vehicle) in a manner that facilitates force concentration effort and enables operating in parallel (concurrently) several means from the same platform.

Furthermore, RCNLWS in accordance with the invention enables operation of the means while (at least partly) being helped by mechanisms that provide accurate aiming at least compared to spontaneous hand or shoulder performed firing, and by day and night efficient observation aids that enable focusing on the illuminated target.

Moreover, with a given multi barrels means for grenades firing mounted in an RCNLWS in accordance with the invention, there are offered the possibilities of firing continuous long or repeated firing salvoes—namely, it becomes possible to use certain (advanced) ammunition kinds that until now could not be exploited in such firing patterns, and while providing for fast loading and repeated grenades firing.

Finally, as we have pointed above, RCNLWS in accordance with the invention instills to army combat units operational flexibility—switching the RCWS means to RCNLWS means—and this with accompanying ease of dismantling modules kind of equipment and replacing by suiting equipment (to other missions), in a relative fast and simple manner.

While the above description contains many specifications, the professional reader should not construe these as limitations on the scope of the RCNLWS which is the subject matter of the invention, but merely examples of embodiments thereof It will be apparent to those skilled in the art of designing and manufacturing RCWS that various modification and variations can be made in the RCNLWS of the present invention without departing from the spirit or scope of the invention. Thus, it is intended that the present invention covers modifications and variations that come under the scope of the following claims and their equivalents.

RCNLWS in accordance with the invention can save lives (both of operators and demonstrators), is feasible (based on existing RCWS), provide for dual use (war fighting application by replacement of modules), is politically acceptable as a crowd control means, cost effective (based on existing RCWS), and easily trainable to both military and police forces.

What is claimed is:

1. A Remote Controlled Weapon Station (RCWS) comprising:

a weapon mounting bracket that is remotely adjustable in elevating/lowering;

a rotatable turret assembly adapted to be mounted on vehicles, remotely adjustable in rotation, and wherein said weapon mounting bracket is pivotally mounted on the rotatable turret assembly;

a camera mounted on said weapon mounting bracket;

at least one non-lethal weapon installed on said RCWS, selected from a group consisting of: a multi-barrels pyrotechnic charge launcher; an audio wave transmitter configured to produce tones, including tones irritating to a human ear; a lighting assembly configured to emit light, including light irritating to a human; and a sniper rifle; and a grenade launcher mounted on said weapon mounting bracket, the grenade launcher comprising:

a multi-barreled assembly having multiple barrels positioned parallel to each other in an array;

a magazine assembly installed inside said grenade launcher and having multiple grenade housings, each said grenade housing being aligned parallel to one of the barrels of the multi-barreled assembly, wherein each said grenade housing is configured to hold a single non-lethal grenade;

a multi-firing-pins assembly mounted behind the magazine assembly, the multi-firing-pins assembly having multiple strikers, wherein each said striker is aligned with one of the grenade housings and electrically operable to fire one of the non-lethal grenades; and a packaging and mounting assembly housing the multi-barreled assembly, the magazine assembly, and the multi-firing-pins assembly, the packaging and mounting assembly being mountable on said weapon mounting bracket and configured to permit extraction of the magazine assembly.

2. The RCWS in accordance with claim 1, wherein— the at least one non-lethal weapon is installed on the weapon mounting bracket, and the at least one non-lethal weapon is selected from a group consisting of: the lighting assembly; and the sniper rifle;

wherein the at least one non-lethal weapon and the grenade launcher are configured to rotate, elevate, and lower together.

3. The RCWS in accordance with claim 1, wherein— said multi-barrels pyrotechnic charge launcher comprises— an array of tubular mountings arranged in an angular sector and configured to house pyrotechnically launched charges; and wherein said array of tubular mountings is mounted on said rotatable turret assembly.

4. The RCWS in accordance with claim 1, wherein— said audio wave transmitter is mounted on said rotatable turret assembly, said audio wave transmitter having a front portion configured to emit said tones and comprises in addition— a first protective cover coupled to the RCWS, the first protective cover covering the front portion of the audio wave transmitter, wherein the first protective cover permits said tones emitted from the audio wave transmitter to transmit through said first protective cover, and wherein said first protective cover pushes away at least some objects thrown towards said front portion of said audio wave transmitter.

5. The RCWS in accordance with claim 4, wherein— said first protective cover is an elastic net configured to temporarily bend and push away an object thrown on said elastic net.

6. The RCWS in accordance with claim 5, wherein— said first protective cover comprises a protecting net component configured to lean on an array of leaf springs, the protecting net being harnessed unto a housing coupled to the audio wave transmitter by a plurality of spiral springs around a circumference of the protecting net.

7. The RCWS in accordance with claim 1, wherein— said lighting assembly is mounted on said weapon mounting bracket, said lighting assembly having a front portion configured to emit said light and comprises in addition— a second protective cover coupled to the RCWS, the second protective cover covering the front portion of the lighting assembly, wherein the second protective cover permits said light emitted from the lighting assembly to transmit through said second protective cover, and wherein said second protective cover pushes away at least some objects thrown towards said front portion of the lighting assembly.

8. The RCWS in accordance with claim 7, wherein— said second protective cover is an elastic net configured to temporarily bend and push away an object thrown on said elastic net.

9. The RCWS in accordance with claim 8, wherein— said second protective cover comprises a protecting net component configured to lean on an array of leaf springs, the protecting net being harnessed unto a housing coupled to the lighting assembly by a plurality of spiral springs around a circumference of the protecting net.

10. The RCWS in accordance with claim 1, wherein— said sniper rifle is mounted on said weapon mounting bracket and is configured to be cocked and fired by remote electric control; wherein said camera is configured to permit an RCWS operator to aim said sniper rifle.

11. The RCWS in accordance with claim 1, further comprising:

at least one protective housing enclosing at least a portion of said at least one non-lethal weapon, each of the at least one protective housings having a plurality of angled faces configured to divert away burning liquid thrown at said at least one protective housing.

12. The RCWS in accordance with claim 1, further comprising:

an audio visual recording system having a memory configured to record images output of said camera and at least a portion of the tones output of said audio wave transmitter.

13. The RCWS in accordance with claim 1, wherein the rotatable turret assembly additionally comprises at least one lethal weapon mounted on the rotatable turret assembly, the at least one lethal weapon selected from a group consisting of a machine gun, a lethal grenades machine gun, an automatic cannon, and a canister housing an anti-tank missile ready to be launched.

* * * * *